US009568881B2

(12) United States Patent
Sasaki

(10) Patent No.: US 9,568,881 B2
(45) Date of Patent: Feb. 14, 2017

(54) RECORDING APPARATUS WITH FLOATING DETECTION

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/637,215

(22) Filed: Mar. 3, 2015

(65) Prior Publication Data

US 2015/0253717 A1 Sep. 10, 2015

(30) Foreign Application Priority Data

Mar. 5, 2014 (JP) ..... 2014-042454

(51) Int. Cl.

*B65H 23/18* (2006.01)
*B65H 26/02* (2006.01)
*G03G 15/00* (2006.01)

(52) U.S. Cl.

CPC *G03G 15/6567* (2013.01); *G03G 2215/00561* (2013.01); *G03G 2215/00616* (2013.01)

(58) Field of Classification Search

CPC ..... G03G 15/6567; G03G 2215/00616; G03G 2215/00561; B65H 2301/3311; B65H 2301/331; B65H 2601/272; B65H 23/0326; B41J 15/046

See application file for complete search history.

(56) References Cited

U.S. PATENT DOCUMENTS 6,409,301 B1 * 6/2002 Takata ..... B41J 29/393 347/19
6,536,705 B1 * 3/2003 Bock ..... B65H 18/26 242/541.4
7,147,316 B2 12/2006 Hayashi et al.
8,206,048 B2 6/2012 Ferrara et al.
2004/0080553 A1 * 4/2004 Kim ..... B41J 25/308 347/8
2008/0239051 A1 * 10/2008 Kato ..... B41J 11/007 347/104
2010/0243698 A1 * 9/2010 Hashimoto ..... B65H 23/048 226/21
2013/0127943 A1 5/2013 Abe (Continued)

FOREIGN PATENT DOCUMENTS

JP 2002365225 A * 12/2002 ..... B65H 26/02
JP 2003-266828 9/2003

(Continued)

*Primary Examiner* — Blake A Tankersley
*Assistant Examiner* — Ruben Parco, Jr.
(74) *Attorney, Agent, or Firm* — Workman Nydegger

(57) ABSTRACT

A recording apparatus includes a transport section that transports a recording medium; and a floating detection section that detects floating of the recording medium. The floating detection section has a plurality of light emitting elements capable of emitting light to positions different from each other in the recording medium and one light receiving element capable of sequentially receiving reflected light emitted from the plurality of light emitting elements. The floating in the different positions is capable of being detected from received light intensity of the reflected light.

11 Claims, 7 Drawing Sheets

(56) References Cited

U.S. PATENT DOCUMENTS

| | | | | |
|---|---|---|---|---|
| 2014/0319194 | A1* | 10/2014 | Swanson | B65H 23/038 226/179 |
| 2015/0239698 | A1* | 8/2015 | Herrmann | B65H 23/032 242/419.5 |

FOREIGN PATENT DOCUMENTS

| | | |
|---|---|---|
| JP | 2003-267591 | 9/2003 |
| JP | 2010-189191 | 9/2010 |
| JP | 2013-107240 | 6/2013 |
| JP | 2003-205654 | 7/2013 |

* cited by examiner

RECORDING APPARATUS WITH FLOATING DETECTION

BACKGROUND

1. Technical Field

The present invention relates to a recording apparatus.

2. Related Art

In the related art, a recording apparatus that performs recording on a recording medium by transporting the recording medium is used. In the recording apparatus having such a configuration, the recording medium may be transported on a skew and a failure occurs by transporting the recording medium on the skew. Thus, a technique for suppressing such a failure is disclosed.

For example, a configuration that receives a coherent light beam that is emitted from a light emitting section and reflected by the recording medium, and calculates a skewed amount and the like from an interference pattern generated in the reflected light is disclosed in JP-A-2003-205654.

In the recording apparatus of the related art described above, a detection section for detecting skew transport of the recording medium is used which is configured of one light emitting element and one light receiving element, or which includes a plurality of detection units configured of such one light emitting element and one light receiving element.

However, in the detection section configured of one light emitting element and one light receiving element, a detection capability of the skew transport of the recording medium may be low. Furthermore, in the detection section including the plurality of detection units configured of one light emitting element and one light receiving element, if the units are arranged close to each other to enhance the detection capability of the skew transport of the recording medium, the light emitted from each light emitting element is unpredictably interfered with and a false detection may occur.

Thus, in the recording apparatus of the related art, control of the failure due to the skew transport of the recording medium may be insufficient.

SUMMARY

An advantage of some aspects of the invention is to suppress a failure due to skew transport of a recording medium.

According to an aspect of the invention, there is provided a recording apparatus including a transport section that transports a recording medium; and a floating detection section that detects floating of the recording medium. The floating detection section has a plurality of light emitting elements capable of emitting light to positions different from each other in the recording medium and one light receiving element capable of sequentially receiving reflected light emitted from the plurality of light emitting elements. The floating in the different positions is capable of being detected from received light intensity of the reflected light.

In this case, the floating detection section has the plurality of light emitting elements capable of emitting light to the positions different from each other in the recording medium and one light receiving element capable of sequentially receiving reflected light emitted from the plurality of light emitting elements, and is capable of detecting the floating in the different positions. As described above, since the floating of the different positions in the recording medium can be sequentially detected, whether or not the recording medium is transported on a skew is detected depending on the position in which the floating is detected and it is possible to detect that the skew transport occurs in which direction if the floating occurs due to skew transport.

In the recording apparatus, the floating detection section may be capable of detecting the floating in the different positions at a plurality of locations in a transport direction of the recording medium by the transport section.

In this case, the floating detection section is capable of detecting the floating in the different positions at the plurality of locations in the transport direction. Thus, detection capability of the skew transport of the recording medium is enhanced and it is possible to effectively suppress a failure due to the skew transport of the recording medium.

In the recording apparatus, the floating detection section may be capable of detecting the floating in the different positions at a plurality of locations in an intersecting direction intersecting the transport direction of the recording medium by the transport section.

In this case, the floating detection section is capable of detecting the floating in the different positions at the plurality of locations in the intersecting direction. Thus, the detection capability of the skew transport of the recording medium is enhanced and it is possible to effectively suppress the failure due to the skew transport of the recording medium.

The recording apparatus may further include a control section that controls transport conditions of the transport section, and in which the control section may adjust a transport speed of the recording medium in the intersecting direction intersecting the transport direction of the recording medium based on a detection result of the floating detection section.

If the skew transport of the recording medium occurs, it is possible to correct the skew transport of the recording medium by adjusting the transport speed of the recording medium in the intersecting direction.

In this case, the control section adjusts the transport speed of the recording medium in the intersecting direction based on the detection result of the floating detection section. Thus, it is possible to detect skew transport of the recording medium early and to correct the skew transport before the failure occurs due to skew transport of the recording medium.

The recording apparatus may further include a determination section that determines whether or not the transport of the recording medium is good based on a detection result of the floating detection section; and an output section that is capable of outputting information about a transport failure if the transport of the recording medium is determined as a failure by the determination section.

In this case, the recording apparatus includes the output section that is capable of outputting information about the transport failure if the transport of the recording medium is determined as the failure by the determination section.

In the recording apparatus, the transport section may have a delivery section capable of delivering the recording medium having a roll shape by rotating the recording medium, and the delivery section may be capable of adjusting a delivery angle of the recording medium based on the detection result.

In this case, the delivery section can adjust the delivery angle of the recording medium based on the detection result.

In the recording apparatus, the transport section may have a delivery section capable of delivering the recording medium having a roll shape by rotating the recording medium, and the delivery section may be capable of moving in an intersecting direction intersecting the transport direction of the recording medium based on the detection result.

In this case, the delivery section is capable of moving in the intersecting direction intersecting the transport direction of the recording medium based on the detection result.

In the recording apparatus, the transport section may have a winding section capable of winding the recording medium in a roll shape by rotating the recording medium, and the winding section may be capable of adjusting a winding angle of the recording medium based on the detection result.

In this case, the winding section is capable of adjusting the winding angle of the recording medium based on the detection result.

In the recording apparatus, the transport section may have a winding section capable of winding the recording medium in a roll shape by rotating the recording medium, and the winding section may be capable of moving in an intersecting direction intersecting the transport direction of the recording medium based on the detection result.

In this case, the winding section is capable of moving in an intersecting direction intersecting the transport direction of the recording medium based on the detection result.

In the recording apparatus, the transport section may have a tension applying section that applies tension to the recording medium, and the tension applying section may be capable of adjusting the tension applied to the recording medium in the intersecting direction based on the detection result.

In this case, the tension applying section is capable of adjusting the tension applied to the recording medium in the intersecting direction based on the detection result.

In the recording apparatus, the transport section may have a pinching section that transports the recording medium by pinching the recording medium, and the pinching section may be capable of adjusting a pinching force in the intersecting direction.

Here, "the pinching section that transports the recording medium by pinching the recording medium" means, for example, including a configuration in which the recording medium is pinched by using a fluid other than a solid as a configuration in which the recording medium is pressed to a driving roller by blowing air to the recording medium, in addition to a configuration in which the recording medium is pinched between solids such as a pair of rollers pinching the recording medium.

In this case, the pinching section is capable of adjusting the pinching force in the intersecting direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described in detail with reference to the drawings.

First Embodiment (FIGS. 1 to 4)

Figure 1:
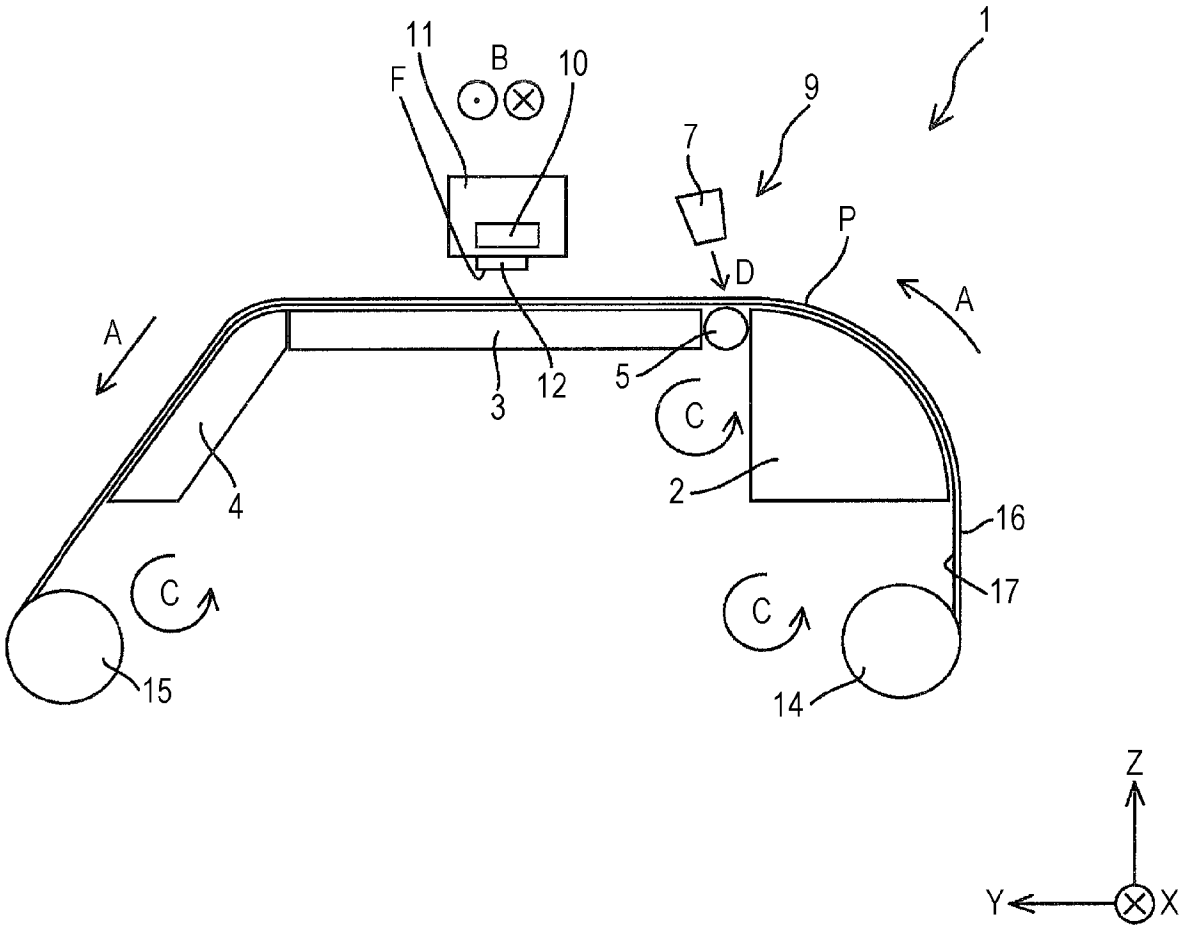
FIG. 1 is a schematic side view illustrating a recording apparatus according to a first embodiment of the invention.

FIG. 1 is a schematic side view illustrating a recording apparatus 1 according to a first embodiment of the invention.

Figure 2:
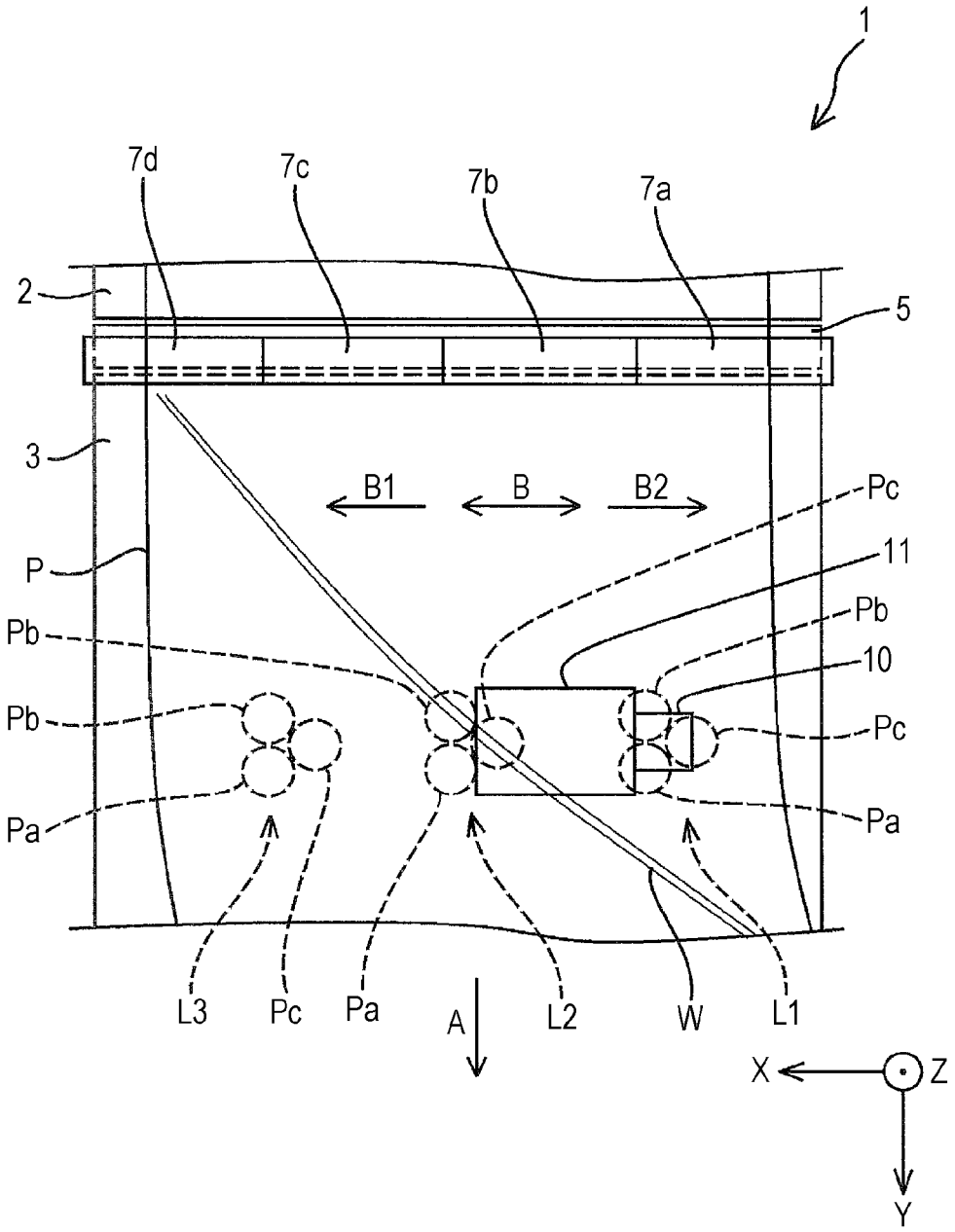
FIG. 2 is a schematic plan view illustrating the recording apparatus according to the first embodiment of the invention.

Furthermore, FIG. 2 is a schematic plan view illustrating the recording apparatus 1 according to the first embodiment of the invention and is a schematic plan view illustrating a floating detection position detected by a sensor 10 as a floating detection section that is a main portion of the recording apparatus 1.

Figure 3:
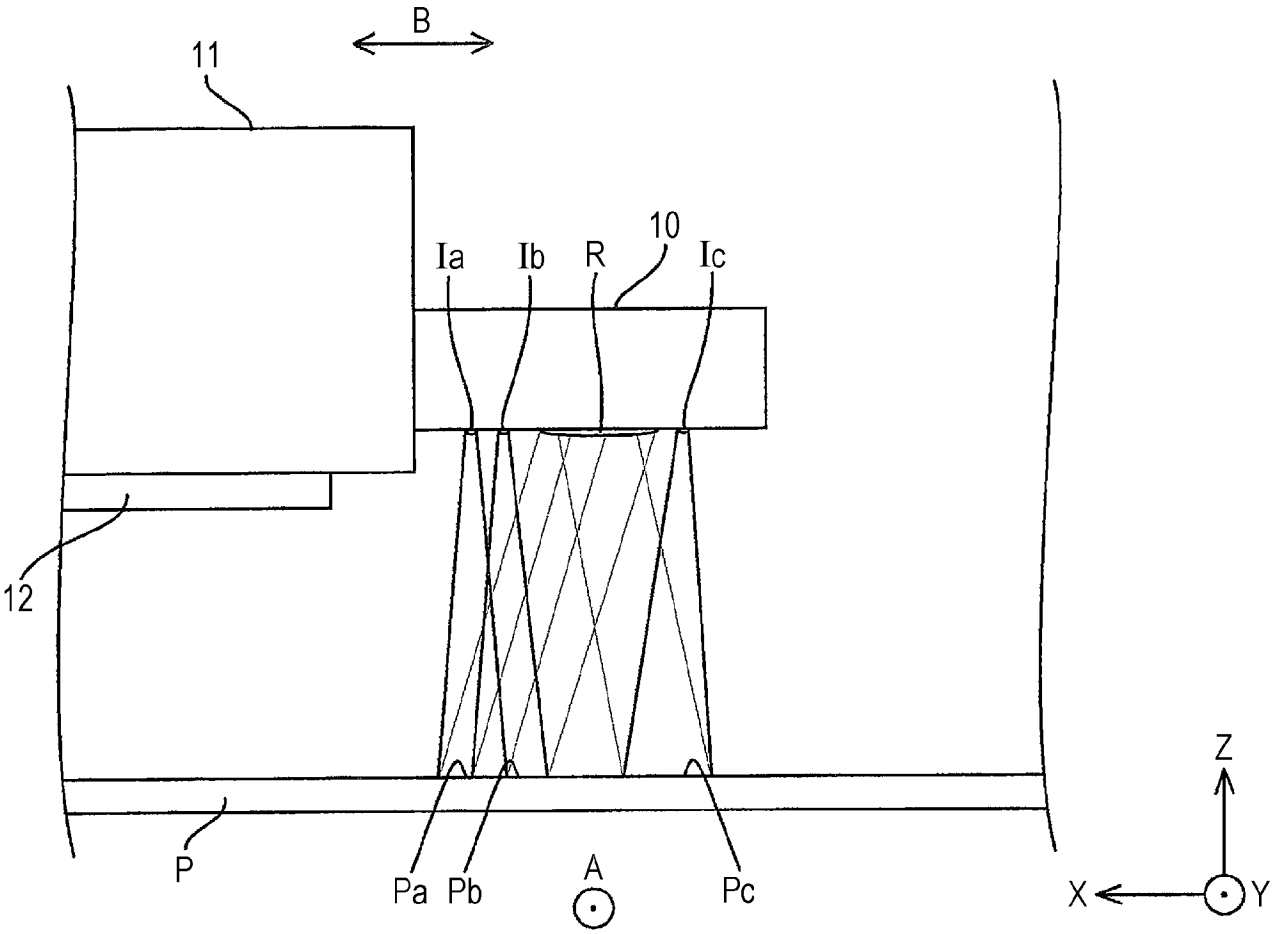
FIG. 3 is a schematic front view illustrating a main portion of the recording apparatus according to the first embodiment of the invention.

Furthermore, FIG. 3 is a schematic front view illustrating the sensor 10 that is a main portion of the recording apparatus 1 according to the first embodiment of the invention.

As illustrated in FIG. 1, the recording apparatus 1 of the embodiment transports a recording medium P in a transport direction A from a delivery section 14 delivering the recording medium P to a winding section 15 of the recording medium P through a platen 2, a platen 3, and a platen 4 that are support sections of the recording medium P. That is, a transport path of the recording medium P in the recording apparatus 1 is provided from the delivery section 14 to the winding section 15. The platen 2, the platen 3, and the platen 4 are the support sections of the recording medium P provided in the transport path. Moreover, the delivery section 14 delivers the recording medium P by rotating in a rotation direction C and the winding section 15 winds up the recording medium P by rotating in the rotation direction C.

Moreover, the recording apparatus 1 of the embodiment has a configuration capable of performing recording on a recording medium P having a roll shape, but is not limited to the configuration and may have a configuration capable of performing recording on a cut-sheet shaped recording medium P. In a case of the configuration capable of performing recording on the cut-sheet shaped recording medium P, as the delivery section 14 of the recording medium P, for example, a member referred to as a so-called sheet feeding (supply) tray, a sheet feeding (supply) cassette, and the like may be used. Furthermore, as a recovery section of the recording medium P, as the recovery section other than the winding section 15, for example, a member referred to as a so-called discharged sheet receiving section, a sheet discharging (ejecting) tray, a sheet discharging (ejecting) cassette, and the like may be used.

The recording apparatus 1 of the embodiment is provided with a driving roller 5 between the platen 2 and the platen 3, and a fan 7 that is a blowing section at a position (upper portion) facing the driving roller 5. The fan 7 can blow air to the driving roller 5 in a direction D. Then, it is possible to press the recording medium P to the driving roller 5 by a wind pressure. A transport section 9 is configured of the driving roller 5 and the fan 7 with such a configuration.

In other words, the transport section 9 has the driving roller 5 that is provided to come in contact with a first surface 17 (rear surface opposite to a recording surface) of the recording medium P and applies a feeding force to the first surface 17, and the fan 7 that is provided at a position facing the driving roller 5 and is capable of blowing the air to a second surface 16 (recording surface) of the recording medium P. Then, the recording medium P is pinched by the driving roller 5 and an air flow generated by the fan 7 and is transported in the transport direction A.

Here, when transporting the recording medium P in the transport direction A, the driving roller 5 rotates in the rotation direction C.

In addition, in the recording apparatus 1 of the embodiment, the transport section 9 of course corresponds to the transport section of the invention and the delivery section 14 and the winding section 15 also correspond to the transport section of the invention because of contributing to the transport of the recording medium P.

As represented by a fan 7*a* to a fan 7*d* in FIG. 2, the fan 7 is divided in an intersecting direction B intersecting the transport direction A. The fan 7*a* to the fan 7*d* can be individually driven by control of a control section 18 (see FIG. 4). In other words, the fan 7 can adjust a pinching force in the intersecting direction B.

According to such a configuration, the control section 18 can adjust the pinching force in the intersecting direction B and can adjust a transport speed of the recording medium P in the intersecting direction B. Specifically, for example, it is possible to release the recording medium P on the fan 7*a* side and to make the transport speed on the fan 7*d* side be slower than the transport speed on the fan 7*a* side by reducing an air amount of the fan 7*a*. The recording apparatus 1 of the embodiment suppresses a failure due to skew transport of the recording medium P by such a simple configuration.

Furthermore, since the transport section 9 of the embodiment transports the recording medium P without pinching the recording medium P by a pair of rollers, a transport failure such as formation of a trace of the roller due to the transport of the recording medium P is suppressed. Particularly, it is possible to prevent a trace of the driven roller from being formed on the recording surface of the recording medium P.

However, the transport section 9 of a configuration may be used in which the driven roller is provided instead of the fan 7, the driving roller 5 and the driven roller pinch the recording medium P, and thereby the recording medium P is transported.

Moreover, in the embodiment, the roll-type recording medium P is used of which the recording surface is on the outside. Thus, when the recording medium P is delivered from the delivery section 14, a rotation shaft of the delivery section 14 rotates in the rotation direction C. Meanwhile, if the roll-type recording medium P is used of which the recording surface is on the inside, the rotation shaft of the delivery section 14 rotates in a reverse direction of the rotation direction C and then the recording medium P can be delivered.

Then, similarly, the winding section 15 of the embodiment winds up the recording medium P so that the recording surface of the recording medium P is on the outside. Thus, a rotation shaft of the winding section 15 rotates in the rotation direction C. Meanwhile, if the recording medium P is wound so that the recording surface is on the inside, the rotation shaft of the winding section 15 rotates in the reverse direction of the rotation direction C and then the recording medium P can be wound.

Furthermore, the recording apparatus 1 of the embodiment includes a recording head 12 as a recording section on a side facing the platen 3. The recording apparatus 1 forms a desired image by ejecting ink from an ink ejecting surface F of the recording head 12 on the recording medium P while reciprocating the recording head 12 in the intersecting direction B through a carriage 11.

Moreover, the recording apparatus 1 of the embodiment includes the recording head 12 that performs the recording while reciprocating, but may be a recording apparatus including a so-called line head in which a plurality of nozzles ejecting the ink are provided in the intersecting direction B.

Here, "line head" is a recording head that is provided so that a region of the nozzles formed in the intersecting direction B intersecting the transport direction A of the recording medium P can cover an entirety of the recording medium P in the intersecting direction B, and that is used in the recording apparatus forming the image by fixing one of the recording head and the recording medium and moving the other thereof. Moreover, the region of the nozzles in intersecting direction B of the line head may not cover an entirety in the intersecting direction B of the entire recording medium P corresponding to the recording apparatus.

Moreover, a direction X and a direction Y in the drawing are respectively horizontal directions orthogonal to each other, and a direction Z is a vertical direction. Thus, in the recording apparatus 1 of the embodiment, the transport direction A of the recording medium P on the platen 3 corresponds to the direction Y and the intersecting direction B corresponds to the direction X.

Moreover, in the recording apparatus 1 of the embodiment, the transport section 9 is provided on an upstream side of the recording head 12 in the transport direction A. However, the transport section 9 may be provided on both sides of the recording head 12 in the transport direction A. In the configuration in which the transport section 9 is provided on the both sides thereof, since the recording medium P can be pressed to the driving roller 5 at both sides, it is possible to effectively suppress a transport failure such as jamming.

Furthermore, as illustrated in FIG. 1, the fan 7 of the transport section 9 blows air in a direction D that is a direction away from the recording head 12. Specifically, the fan 7 blows the air in the direction D to the upstream side in the transport direction A. Thus, it is suppressed the air that is blown from the fan 7 affects a flight condition of the ink ejected from the recording head 12 and an landing position shift of the ink onto the recording medium P is generated. Furthermore, foreign matter attached to the second surface 16 of the recording medium P are removed by the blowing of the air and it is possible to suppress occurrence of the recording failure.

Moreover, the fan 7 of the embodiment blows the air such that the wind flows in a reverse direction of a direction toward the recording head, but may blow the air such that the wind flows in an intersecting direction of the direction toward the recording head. In this case, ink mist ejected from the recording head 12, floating between the recording head 12 and the recording medium P, is prevented from attaching to the recording head 12 again and it is possible to stably eject the ink from the recording head 12. However, a configuration in which the blowing direction of the fan 7 is a direction toward the recording head 12 is included in the invention. Furthermore, a configuration may be provided in which a plurality of fans 7 are arranged in the intersecting direction of the transport direction A, and each fan can change a direction of the wind individually by a position of the carriage 11 moving in the direction B on the downstream side in the transport direction. For example, a configuration may be provided in which the fan on the downstream side in the moving direction of the carriage 11 in the direction B blows the air to the downstream side and thereby the wind flows in the reverse direction of a direction toward the recording head 12.

Furthermore, the carriage 11 is provided with the sensor 10 as a floating detection section that detects the floating of the recording medium P. Moreover, the sensor 10 also serves as a width detection section capable of detecting the width of the recording medium P in the intersecting direction B.

As illustrated in FIG. 3, the sensor 10 has a plurality of light emitting elements Ia, Ib, and Ic capable of applying infrared light toward different positions Pa, Pb, and Pc of the recording medium P, and one light receiving element R capable of sequentially receiving a reflected light of the infrared light that is applied by switching the light emitting elements Ia, Ib, and Ic. Moreover, the position Pa corresponds to an irradiation region by the light emitting element Ia, the position Pb corresponds to an irradiation region by the light emitting element Ib, and the position Pc corresponds to an irradiation region by the light emitting element Ic. It is possible to detect the floating in a plurality of positions by calculating a distance from received light intensity of the reflected light in the different positions Pa, Pb, and Pc. As described above, since the floating can be sequentially detected in the plurality of positions of the different positions Pa, Pb, and Pc of the recording medium P, as described below, it is possible to detect whether the floating is generated only at a specific position, whether or not a wrinkle W is generated by continuous floating, in which direction the wrinkle W generated by the continuous floating is generated, and whether skew transport is performed depending on the position at which the floating is detected.

According to such a configuration, in the recording apparatus 1 of the embodiment, it is possible to change transport conditions of the recording medium P in the transport section 9 based on a detection result of the sensor 10 and it is possible to suppress the failure due to the generation of the wrinkle W or the skew transport of the recording medium P.

Moreover, the recording apparatus 1 of the embodiment has three light emitting elements as the plurality of light emitting elements capable of applying the infrared light toward different positions of the recording medium P, but may have two light emitting elements, or may have four or more light emitting elements. For example, if the recording apparatus 1 has three light emitting elements, a process in which the light is emitted from the light emitting element Ia and is received in the light receiving element R, the light is emitted from the light emitting element Ic and is received in the light receiving element R, and the light is emitted from the light emitting element Ib and is received in the light receiving element R is sequentially repeatedly performed, and then the distance is calculated from the received light intensity of the reflected light thereby detecting the floating. If the light emission of the light emitting elements Ia and Ib disposed on the uppermost upstream side and the lowermost downstream side of the carriage 11 among the light emitting elements Ia, Ib, and Ic is sequentially repeated, the received light intensity of the reflected light is detected by the light receiving element R, and the floating is detected, the light emission of the light emitting element Ic may be performed at a timing between the light emissions of the light emitting elements Ia and Ib. In this case, the floating generated from the upstream side or downstream side in the transport direction is detected and it is possible to detect that the wrinkle W is generated due to the floating.

Furthermore, as illustrated in FIG. 2, the sensor 10 of the embodiment is configured to be capable of detecting the floating at the different positions Pa, Pb, and Pc of the recording medium P in the plurality of locations L1, L2, and L3 in the intersecting direction B.

Thus, detection capability of the skew transport of the recording medium P is increased and the failure due to the skew transport of the recording medium P is effectively suppressed.

Moreover, the sensor 10 of the embodiment is configured such that the floating detection section is provided movably in the intersecting direction B and detects the floating in the plurality of locations in the intersecting direction B while moving, but may be configured such that the floating detection sections are provided in a plurality of locations in the intersecting direction B. That is, a configuration in which "floating can be detected in the different positions Pa, Pb, and Pc of the recording medium P in the plurality of locations L1, L2, and L3 in the intersecting direction B" includes a configuration in which the floating detection section is provided movably in the intersecting direction B and detects the floating in the plurality of locations in the intersecting direction B while moving, in addition to the configuration in which the floating detection sections are provided in the plurality of locations in the intersecting direction B.

Specifically how to determine whether or not the floating is generated due to the skew transport and in which direction the skew is generated if the floating is due to the skew transport depending on positions at which the floating is detected among the different positions Pa, Pb, and Pc of the recording medium P will be described below.

However, the following description is a determination example in a case where the recording apparatus 1 of the embodiment is used and is not limited to such a determination example.

As illustrated in FIG. 2, if the recording medium P is skewed in a direction to a home position side (right side in the drawing) in the intersecting direction B as being transported to the downstream side in the transport direction A, the wrinkle W is generated toward the right side in the drawing as the recording medium P is transported to the downstream side in the transport direction A. If such a wrinkle W is generated, the sensor 10 detects the floating at the position Pb and Pc in the location L2. Thus, if the floating is detected at the positions Pb and Pc, it is determined that the floating is generated due to the skew transport and it is determined that the recording medium P is skewed in a direction to the home position side in the intersecting direction B as the recording medium P is transported to the downstream side in the transport direction A.

Moreover, the location is not limited to the location L2 and if the sensor 10 detects the floating at the positions Pb and Pc in at least one of the locations L1, L2, and L3, it is determined that the floating is generated due to the skew transport and it is determined that the recording medium P is skewed in the direction to the home position side in the intersecting direction B as the recording medium P is transported to the downstream side in the transport direction A.

Meanwhile, if the floating is detected at the positions Pa and Pc, it is determined that the floating is generated due to the skew transport and it is determined that the recording medium P is skewed in the reverse direction of a direction to the home position side in the intersecting direction B as the recording medium P is transported to the downstream side in the transport direction A.

Furthermore, if the floating is detected only at one of the positions Pa, Pb, and Pc, it is determined that partial floating is generated and it is determined that the transport of the recording medium P is not skewed.

Furthermore, if the floating is detected at all of the positions Pa, Pb, and Pc, it is determined that the transport of the recording medium P is not skewed and that the recording medium P is jammed, and driving of the delivery section 14, the transport section 9, and the winding section 15 is stopped.

In addition, all the determination and control described above are performed by the control of the control section 18 described below.

Next, an electrical configuration in the recording apparatus 1 of the embodiment will be described.

Figure 4:
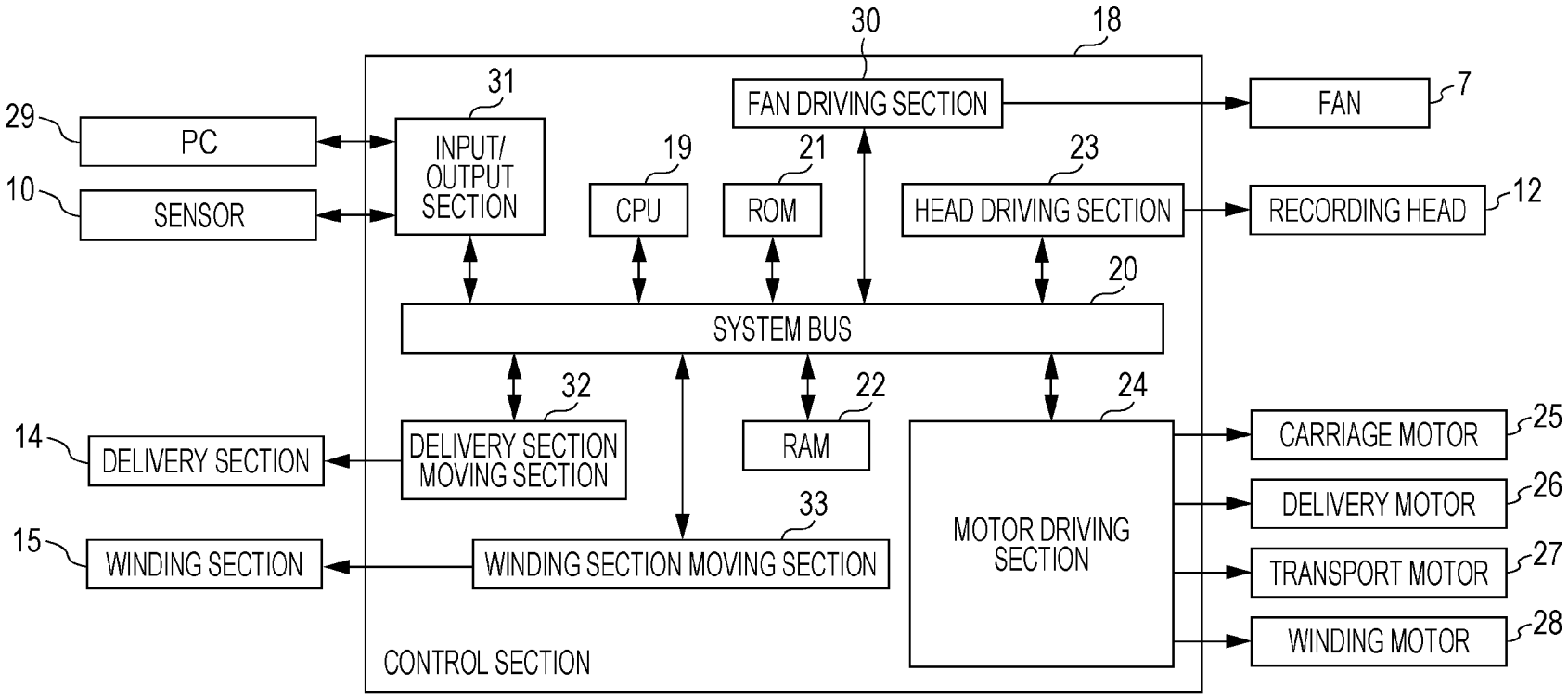
FIG. 4 is a block diagram illustrating the recording apparatus according to the first embodiment of the invention.

FIG. 4 is a block diagram of the recording apparatus 1 of the embodiment.

The control section 18 is provided with a CPU 19 which controls an entirety of the recording apparatus 1. The CPU 19 is connected to a ROM 21 storing various control programs or maintenance sequence, and the like which are executed by the CPU 19 and a RAM 22 temporarily storing data though a system bus 20.

Furthermore, the CPU 19 is connected to a head driving section 23 for driving the recording head 12 though the system bus 20.

Furthermore, the CPU 19 is connected to a motor driving section 24 for driving a carriage motor 25 for moving the carriage 11, a delivery motor 26 that is a driving source of the delivery section 14, a transport motor 27 that is a driving source of the driving roller 5, and a winding motor 28 that is a driving source of the winding section 15 though the system bus 20.

Furthermore, the CPU 19 is connected to a fan driving section 30 for driving the fan 7 though the system bus 20.

Furthermore, the CPU 19 is connected to a delivery section moving section 32 for moving the delivery section 14 in the direction X and the direction Z though the system bus 20.

Furthermore, the CPU 19 is connected to a winding section moving section 33 for moving the winding section 15 in the direction X and the direction Z though the system bus 20.

In addition, the CPU 19 is connected to an input/output section 31 though the system bus 20 and the input/output section 31 is connected to the sensor 10 and a PC 29 that is an external device inputting recording data and the like into the recording apparatus 1.

The control section 18 of the embodiment can perform the control of the transport conditions of the transport section 9, the delivery section 14, and the winding section 15, and can adjust the transport speed of the recording medium P in the intersecting direction B based on the detection result of the sensor 10.

If the skew transport of the recording medium P is generated, it is possible to correct the skew transport of the recording medium P by adjusting the transport speed of the recording medium P in the intersecting direction B. For example, as illustrated in FIG. 2, if the recording medium P is transported by being pulled to one side in the intersecting direction B as the recording medium P is directed toward the downstream side in the transport direction, it is possible to correct the skew transport of the recording medium P by slowing the transport speed on a side which is pulled.

Since the control section 18 of the embodiment adjusts the transport speed of the recording medium P in the intersecting direction B based on the detection result of the sensor 10, the recording apparatus 1 of the embodiment can detect the skew transport of the recording medium P early and correct the skew transport before the failure due to the skew transport of the recording medium P being generated.

Furthermore, the control section 18 of the embodiment serves as a determination section determining whether or not the transport of the recording medium P is good based on the detection result of the sensor 10 and serves as an output section outputting transport failure information to the PC 29 if the transport of the recording medium P is bad.

Here, "determination whether or not the transport is good" means that a case where the skew transport, the jamming, and the like are not generated is determined as "good" and a case where at least one of the skew transport and the jamming is generated is determined as "bad".

Thus, the transport failure information is output to the PC 29 and the information is indicated in a monitor of the PC 29, and thereby it is possible to notify a user that the transport of the recording medium P has failed.

Moreover, a configuration may be provided in which the recording apparatus 1 is provided with a monitor, the transport failure information is output to the monitor, and the information is displayed on the monitor.

Furthermore, as described above, the recording apparatus 1 of the embodiment has the delivery section 14 capable of delivering the recording medium P having a roll shape by rotating the recording medium P.

Then, the control section 18 can adjust the delivery angle of the recording medium P by moving the delivery section 14 though the delivery section moving section 32 based on the detection result of the sensor 10.

Specifically, at least one of one side and the other side can be moved along the direction Z so that heights of the one side and the other side of end portions of the delivery section 14 in the direction X are different from each other.

According to such a configuration, the control section 18 moves the delivery section 14 and adjusts the delivery angle of the recording medium P, and thereby the control section 18 can adjust the transport speed of the recording medium P in the intersecting direction B. Thus, the failure due to the skew transport of the recording medium P is suppressed by moving the delivery section 14 without adding a new separate configuration member.

Furthermore, the control section 18 can entirely move the delivery section 14 though the delivery section moving section 32 along the direction X based on the detection result of the sensor 10.

According to such a configuration, the control section 18 moves the delivery section 14 and adjusts the delivery angle of the recording medium P, and thereby the control section 18 can adjust the transport speed of the recording medium P in the intersecting direction B. Thus, the failure due to the skew transport of the recording medium P is suppressed by moving the delivery section 14 without adding a new separate configuration member.

Furthermore, as described above, the recording apparatus 1 of the embodiment has the winding section 15 capable of winding the recording medium P having a roll shape by rotating the recording medium P.

Then, the control section 18 can adjust the winding angle of the recording medium P by moving the winding section 15 though the winding section moving section 33 based on the detection result of the sensor 10.

Specifically, at least one of one side and the other side can be moved along the direction Z so that heights of the one side and the other side of end portions of the winding section 15 in the direction X are different from each other.

According to such a configuration, the control section 18 moves the winding section 15 and the winding angle of the recording medium P is adjusted, and thereby the control section 18 can adjust the transport speed of the recording medium P in the intersecting direction B. Thus, the failure due to the skew transport of the recording medium P is suppressed by moving the winding section 15 without adding a new separate configuration member.

Furthermore, the control section 18 can entirely move the winding section 15 though the winding section moving section 33 along the direction X based on the detection result of the sensor 10.

According to such a configuration, the control section 18 moves the winding section 15 and adjusts the winding angle of the recording medium P, and thereby the control section 18 can adjust the transport speed of the recording medium P in the intersecting direction B. Thus, the failure due to the skew transport of the recording medium P is suppressed by moving the winding section 15 without adding a new separate configuration member.

Figure 5:
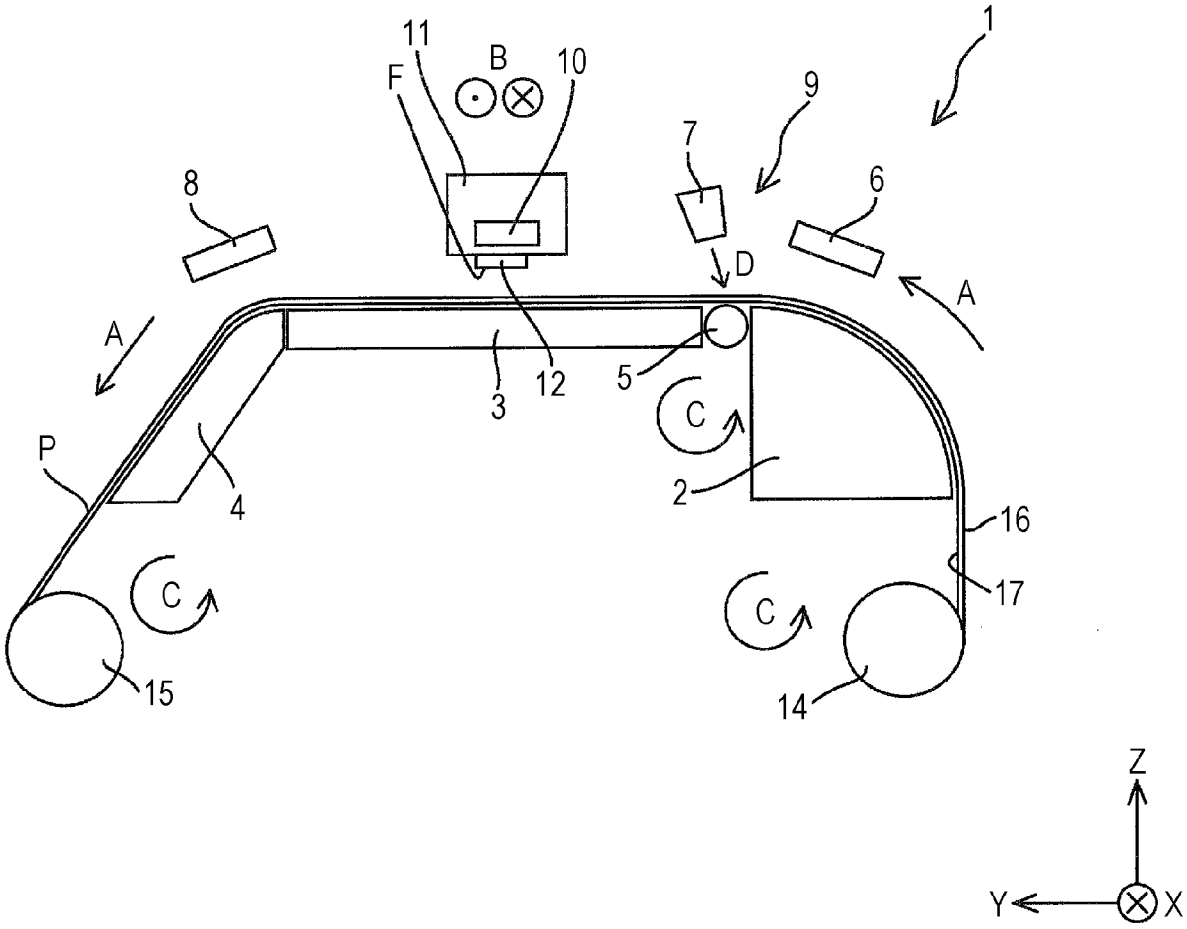
FIG. 5 is a schematic side view illustrating a recording apparatus according to a second embodiment of the invention.

Second Embodiment (FIG. 5)

Next, a recording apparatus of a second embodiment will be described in detail with reference to the accompanying drawing.

FIG. 5 illustrates a schematic side view of a recording apparatus 1 of the embodiment. Moreover, the same reference numerals are given to the configuration members common to those of the embodiment described above and detailed description will be omitted.

Moreover, the recording apparatus 1 of the embodiment has the same configuration as the recording apparatus 1 of the first embodiment except that sensors as floating detection sections for detecting floating of a recording medium P are further provided on an upstream side of a transport section 9 and on a downstream side of a recording head 12 in the transport direction A.

As illustrated in FIG. 5, the recording apparatus 1 of the embodiment includes a sensor 6 on the upstream side of the transport section 9 in the transport direction A and includes a sensor 8 on the downstream side of the recording head 12 in the transport direction A. Here, the sensor 6 and the sensor 8 have the same configuration and have a configuration in which a plurality of sensor units having a configuration similar to a sensor 10 are provided in the intersecting direction B. Then, the control section 18 can perform control similar to the recording apparatus 1 of the first embodiment based on detection results of the sensor 6 and the sensor 8 in addition to a detection result of the sensor 10.

As described above, the recording apparatus 1 of the embodiment can detect the floating at different positions Pa, Pb, and Pc in a plurality of locations in the transport direction A by including the sensor 6 and the sensor 8 in addition to the sensor 10.

Thus, detection capability of the skew transport of the recording medium P is increased and failure due to the skew transport of the recording medium P is effectively suppressed.

Moreover, the sensor 6 and the sensor 8 of the embodiment have the configuration in which the sensor units as the floating detection section are provided in a plurality of locations in the intersecting direction B, but may have a configuration in which the floating detection section is provided movably in the transport direction A and detects the floating in the plurality of locations in the transport direction A while moving. Furthermore, the recording apparatus 1 of the embodiment has the configuration in which the sensors 6, 8, and 10 are provided as the floating detection section in the plurality of locations in the transport direction A, but may have a configuration in which a sensor is provided movably in the transport direction A and detects the floating at a plurality of locations in the transport direction A while moving instead of the sensors 6, 8, and 10. That is, "floating can be detected at the different positions Pa, Pb, and Pc in the plurality of locations in the transport direction A" includes a configuration in which the floating detection section is provided movably in the transport direction A and detects the floating in a plurality of locations in the transport direction A while moving in addition to the configuration in which the floating detection section is provided in the plurality of locations in the transport direction A.

Furthermore, if the floating is detected by the sensor 6, the skew transport of the recording medium P is corrected by adjusting the delivery angle of the recording medium P by moving the delivery section 14, and if the floating is detected by the sensor 10, the skew transport of the recording medium P may be corrected by adjusting the winding angle of the recording medium P by moving the winding section 15.

Figure 6:
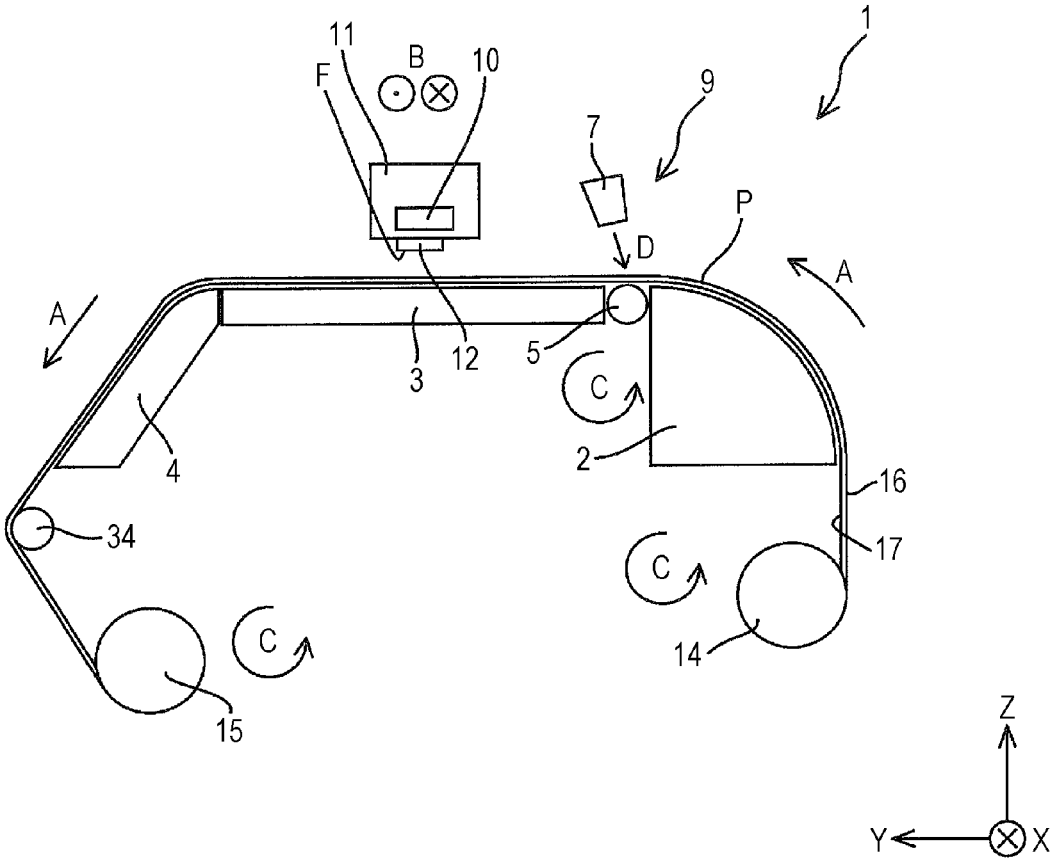
FIG. 6 is a schematic side view illustrating a recording apparatus according to a third embodiment of the invention.

Third Embodiment (FIG. 6)

Next, a recording apparatus of a third embodiment will be described in detail with reference to the accompanying drawing.

FIG. 6 illustrates a schematic side view of a recording apparatus 1 of the embodiment. Moreover, same reference numerals are given to the configuration members common to those of the embodiment described above and detailed description will be omitted.

Moreover, the recording apparatus 1 of the embodiment has the same configuration as the recording apparatus 1 of the first embodiment except that a tension bar 34 as a tension applying section for applying tension in a transport direction A to a recording medium P is further provided on the downstream side of a platen 4 and on an upstream side of a winding section 15 in the transport direction A.

The tension bar 34 of the embodiment is configured of a bar extending in a intersecting direction B. Furthermore, a control section 18 of the embodiment has a tension bar moving section that is entirely movable along a direction X and can move at least one of one side and the other side of the tension bar 34 in a direction Z so that heights of the one side and the other side of the end portions of the tension bar 34 in a direction X are different from each other.

The recording apparatus 1 of the embodiment configures a transport section, has a tension applying section for applying tension to the recording medium P, and a control section 18 of the embodiment can adjust the tension applied to the recording medium P in the intersecting direction B by moving the tension bar 34.

The control section 18 can adjust a transport speed of the recording medium P in the transport direction A by adjusting tension in the intersecting direction B. Since the tension bar 34 can be simply configured, the recording apparatus 1 of the embodiment simply suppresses a failure due to the skew transport of the recording medium P by such a configuration.

Figure 7:
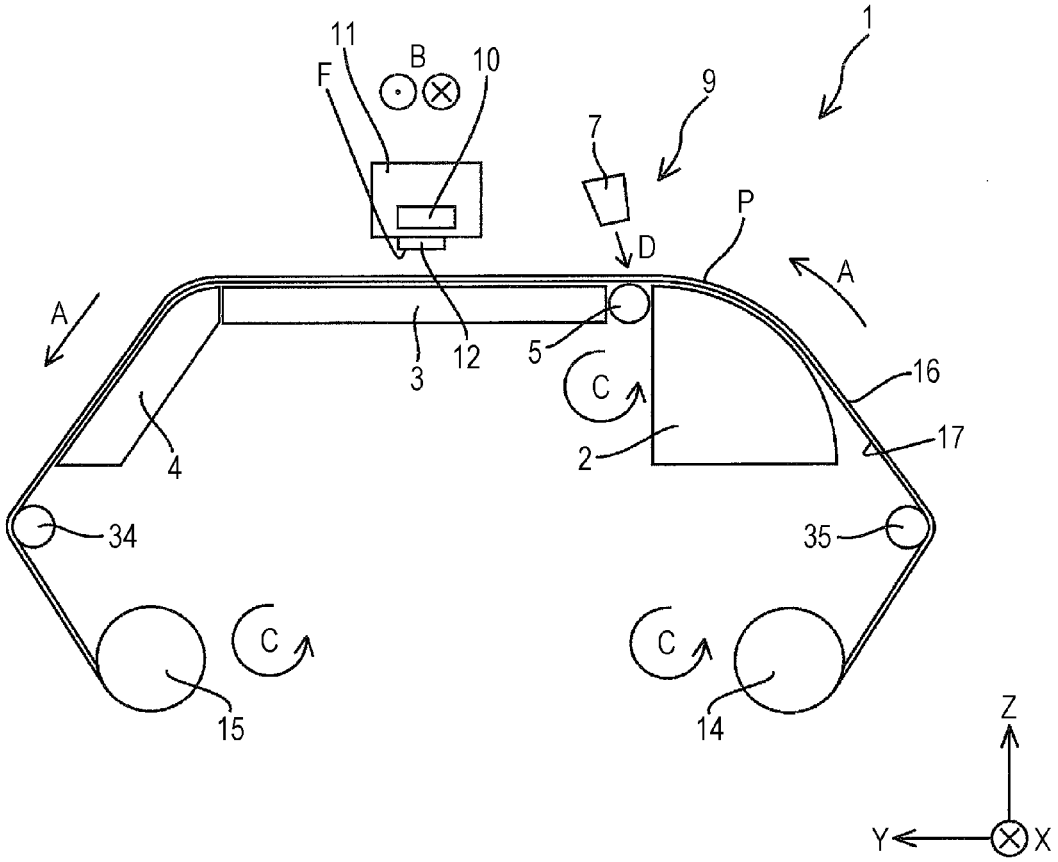
FIG. 7 is a schematic side view illustrating a recording apparatus according to a fourth embodiment of the invention.

Fourth Embodiment (FIG. 7)

Next, a recording apparatus of a fourth embodiment will be described in detail with reference to the accompanying drawing.

FIG. 7 illustrates a schematic side view of a recording apparatus 1 of the embodiment. Moreover, same reference numerals are given to the configuration members common to those of the embodiment described above and detailed description will be omitted.

Moreover, the recording apparatus 1 of the embodiment has the same configuration as the recording apparatus 1 of the third embodiment except that a tension bar 35 as a tension applying section for applying tension to a recording medium P in a transport direction A is further provided on the downstream side of a delivery section 14 and on an upstream side of a platen 2 in the transport direction A.

The tension bar 35 of the embodiment has the same configuration as that of the tension bar 34 and is configured of a bar extending in an intersecting direction B. Furthermore, a control section 18 of the embodiment has a tension bar moving section that is entirely movable in a direction X and can move at least one of one side and the other side of the tension bars 34 and 35 in the Z direction so that heights of the one side and the other side of the end portions of the tension bars 34 and 35 in the direction X are different from each other.

The recording apparatus 1 of the embodiment configures a transport section and has a tension applying section for applying tension to the recording medium P, and a control section 18 of the embodiment can adjust the tension applied to the recording medium P in the intersecting direction B by moving the tension bars 34 and 35.

The control section 18 can adjust a transport speed of the recording medium P in the transport direction A by adjusting tension in the intersecting direction B. Since the tension bars 34 and 35 can be simply configured, the recording apparatus 1 of the embodiment simply suppresses a failure due to the skew transport of the recording medium P by such a configuration.

The entire disclosure of Japanese Patent Application No.2014-042454, filed Mar. 5, 2014 is expressly incorporated by reference herein.

What is claimed is:

1. A recording apparatus comprising:

a transport section that transports a recording medium; and a floating detection section that detects floating of the recording medium, wherein the floating detection section has a plurality of light emitting elements capable of emitting light to positions different from each other on the recording medium and one light receiving element capable of sequentially receiving reflected light emitted from the plurality of light emitting elements, the plurality of light emitting elements and the light receiving element being adjacent to each other on a carriage that includes a recording head, and wherein the floating in the different positions is capable of being detected from received light intensity of the reflected light.

2. The recording apparatus according to claim 1, wherein the floating detection section is capable of detecting the floating in the different positions at a plurality of locations in a transport direction of the recording medium by the transport section.

3. The recording apparatus according to claim 1, wherein the floating detection section is capable of detecting the floating in the different positions at a plurality of locations in an intersecting direction intersecting the transport direction of the recording medium by the transport section.

4. The recording apparatus according to claim 1, further comprising:

a control section that controls transport conditions of the transport section, wherein the control section adjusts a transport speed of the recording medium in the intersecting direction intersecting the transport direction of the recording medium based on a detection result of the floating detection section.

5. The recording apparatus according to claim 1, further comprising:

a determination section that determines whether or not the transport of the recording medium is good based on a detection result of the floating detection section; and an output section that is capable of outputting information about a transport failure if the transport of the recording medium is determined as a failure by the determination section.

6. The recording apparatus according to claim 1, wherein the transport section has a delivery section capable of delivering the recording medium having a roll shape by rotating the recording medium, and wherein the delivery section is capable of adjusting a delivery angle of the recording medium based on the detection result.

7. The recording apparatus according to claim 1, wherein the transport section has a delivery section capable of delivering the recording medium having a roll shape by rotating the recording medium, and wherein the delivery section is capable of moving in an intersecting direction intersecting the transport direction of the recording medium based on the detection result.

8. The recording apparatus according to claim 1, wherein the transport section has a winding section capable of winding the recording medium in a roll shape by rotating the recording medium, and wherein the winding section is capable of adjusting a winding angle of the recording medium based on the detection result.

9. The recording apparatus according to claim 1, wherein the transport section has a winding section capable of winding the recording medium in a roll shape by rotating the recording medium, and wherein the winding section is capable of moving in an intersecting direction intersecting the transport direction of the recording medium based on the detection result.

10. The recording apparatus according to claim 1, wherein the transport section has a tension applying section that applies tension to the recording medium, and wherein the tension applying section is capable of adjusting the tension applied to the recording medium in the intersecting direction based on the detection result.

11. The recording apparatus according to claim 1, wherein the transport section has a pinching section that transports the recording medium by pinching the recording medium, and wherein the pinching section is capable of adjusting a pinching force in the intersecting direction.

* * * * *